US006423259B1

(12) United States Patent
Stewart et al.

(10) Patent No.: US 6,423,259 B1
(45) Date of Patent: Jul. 23, 2002

(54) PROCESS FOR FINISHING THE SURFACE OF A CORONA DISCHARGE TREATMENT ROLLER

(75) Inventors: Arthur M. Stewart, Victor; Brian S. Rice, Fairport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/391,027

(22) Filed: Sep. 7, 1999

Related U.S. Application Data

(62) Division of application No. 08/980,538, filed on Dec. 1, 1997, now abandoned.

(51) Int. Cl.[7] ..... B29C 35/08
(52) U.S. Cl. ..... 264/400; 264/162; 219/121.69
(58) Field of Search ..... 264/139, 162, 264/400, 482; 219/121.69

(56) References Cited

U.S. PATENT DOCUMENTS 4,426,757 A * 1/1984 Hourticolon et al. ..... 29/121.8
4,839,517 A * 6/1989 Dinter ..... 250/325
4,850,089 A * 7/1989 Monfort et al. ..... 29/121.8
4,912,824 A * 4/1990 Baran ..... 29/121.2
4,970,768 A * 11/1990 Lioy et al. ..... 29/121.8
4,977,656 A * 12/1990 Lioy et al. ..... 29/121.8
5,229,813 A * 7/1993 Cherian ..... 355/200
5,324,248 A * 6/1994 Quigley ..... 429/50
5,645,740 A * 7/1997 Naiman et al. ..... 219/121.68
5,759,473 A * 6/1998 Minke et al. ..... 264/400
5,783,797 A * 7/1998 Xuan et al. ..... 219/121.69

* cited by examiner

*Primary Examiner*—Jan H. Silbaugh
*Assistant Examiner*—Stefan Staicovici
(74) *Attorney, Agent, or Firm*—Clyde E. Bailey, Sr.

(57) ABSTRACT

A corona discharge web conveyance roller (10) and process for finishing the surface (14) of the roller (10) with plateaus (30) and down features (22) adjacent to the plateaus. Interconnected channels (30) formed in the surface (14) of the roller (10) by overlapping down features (22) comprise at least 50% of the surface area while plateaus (30) comprise at least 20% to about 50% of the surface of the roller. Down features (22) have depths greater than about 12 microns but less than about 125 microns.

3 Claims, 3 Drawing Sheets

PROCESS FOR FINISHING THE SURFACE OF A CORONA DISCHARGE TREATMENT ROLLER

CROSS REFERENCE TO RELATED APPLICATIONS

This is a divisional of application Ser. No. 08/980,538, filed Dec. 01, 1997 now abandoned.

FIELD OF THE INVENTION

The present invention relates to web conveying rollers, and more particularly to roller surface finish and a process for finishing the surface of a corona discharge treatment roller, so that dynamic air entrained between the roller surface and the web can be vented from the roller surface when the roller and web are in contact.

BACKGROUND OF THE INVENTION

In many manufacturing operations a web is trained around a plurality of rollers as it is conveyed through a series of stations. Some of the rollers are drive rollers for advancing the web and other rollers are simple idler rollers. Typically the web conveyance system is designed to avoid relative movement between the surface of the rollers and the web in order to avoid scratching or otherwise damaging the web. This is especially important during the manufacture of sensitive materials, such as photographic films, paper and magnetic media where such relative movement can produce a surface defect in the final product. Thus it is desirable that the surface of the rollers be sufficiently smooth to avoid damage to the web by the rollers whether the rollers are drive rollers or idler rollers. At the same time, it is important that there be sufficient friction between the roller and the web to enable the corona discharge treatment (CDT) roller to be rotated by the web at the same velocity of the web when the web is in contact with the roller.

More particularly, in corona discharge treatment processes web is trained around a treatment roller as it is conveyed through the process. CDT rollers are simply smooth idler rollers and others work with a nip roller configuration. Existing CDT roller surfaces are made from silicone rubber, Hypalon® rubber, ceramic, epoxy quartz, glass or some metals. Typically the corona discharge treatment web conveyance system is designed to avoid relative movement between the surface of the treatment roller and the web in order to avoid scratching or other damage to the web. This is especially important during the manufacture of sensitive materials, such as photographic films and paper where such relative movement can produce a surface defect in the final product. Thus it is desirable that the surface of the rollers be sufficiently smooth to avoid damage to the web by the roller. At the same time, it is important that there be sufficient friction between the rollers and the web to enable the corona discharge treatment rollers to be rotated by the web at the same surface velocity of the web when the web is in contact with the roller.

As in other web transport systems air can become entrained between the roller and the surface of the web. Movement of the web and roller can force air into the entrance nip between the web and the surface of the roller, especially when the web is moving at high speeds. This forced air forms a boundary layer of air and can cause at least partial separation between the surface of the web and the surfaces of the rollers. When this occurs, there is a change in the ability of the corona discharge treatment process to effectively treat the face side of the web, and the web cannot efficiently rotate the idler rollers. As a result, relative movement can occur between the rollers and the web, causing quality defects in the web.

FIG. 1 illustrates a speed-traction performance curve for a web on a prior art smooth surfaced 8-inch diameter corona discharge treatment roller. As is apparent from FIG. 1, the coefficient of friction between the web and the surface of a typical prior art type roller drops rapidly over the range of web speed up to 900 feet per minute. Thus, as higher roller speeds are required to meet demanding production schedules, existing roller surface traction is simply insufficient to convey the web without incurring enormous and expensive problems.

Smooth surfaced corona discharge treatment rollers are used when web speeds are low and the level of entrained air is low such that web/corona discharge treatment roller slippage is not a problem. At increased web speeds the use of a nip roller configuration is used to minimize entrained air and prevent web/corona discharge treatment roller slippage. However, nip rollers can not be used with certain film and paper webs that might be scratched or creased.

There have been attempts to solve the problems caused by the boundary layer of air between a metal type roller and the web. One such prior art attempt is disclosed in U.S. Pat No. 4,426,757. The web guide roller disclosed in such the '757 patent has cavities on its outer surface which receive air carried with the moving web. More specifically, the cavities comprise a finely branched network of compression chambers that are arranged on the roller surface between plateau-like smoothly ground and polished areas which contact the web. Air in these chambers is compressed between the web and the roller. Air enters these chambers at the point where the web first contacts the roller, and the air is discharged from the chambers at the point where the web runs off the roller.

U.S. Pat. No. 3,405,855 discloses a plurality of grooves in the surface of a roller to control the air boundary layer. The grooves as disclosed in this patent provide passages for the discharge of the air. These grooves are specially formed in the surface of the roller in a predetermined periodic pattern, e.g., by a cutting operation. The grooves can leave thermal defects caused, for example, by the portion of a web in contact with the roller surface drying differently than the portion of the web over the grooves.

The problem with the use of venting patterns on corona discharge treatment rollers is the corona discharge treatment process can produce a latent image on the web from the corona discharge treatment roller venting pattern. After the web coating process the resulting patterned marks are easily observed by the human eye. These marks are clearly undesirable, especially in photographic products such as film or paper.

Therefore, a need persists for a web conveying roller that has a surface finish that eliminates the boundary air layer between the surface of the roller and the web, that is easy to manufacture and cost effective to produce.

SUMMARY OF THE INVENTION

It is, therefore, an object of the present invention to control dynamic air entrainment between a roller surface and a moving web at high speed.

Another object of the present invention is to vent air from between a roller surface and a moving web without requiring a specifically formed repeating pattern of grooves in the roller.

Yet another object of the invention is to provide a process for finishing the surface of the roller so that surface effectively vents air between the roller and the web supported on the surface.

Still another object of the invention is to provide an apparatus for conveying a web in a coating process on a corona discharge treatment roller that does not produce latent defects on the web.

Yet another object of the invention is to provide a corona discharge treatment roller with a surface finish having a non-periodic pattern formed by a shallow texture produced by the use of a laser engraving.

Accordingly for accomplishing these and other objects of the invention, there is provided, in one aspect of the invention, a web conveyance roller having a surface with generally down features, many of the down features overlapping to form interconnected channels comprising at least 50% of the surface area of the roller, the depth of the down features being greater than about 12 microns but less than about 125 microns, and a plurality of spatially separated plateaus between the channels comprising between at least 20% of the surface of the roller.

In another aspect of the invention, a process for finishing the surface of a roller of the type comprising materials selected from the group consisting of elastomers, ceramics, and epoxy quartz or a combination thereof, the roller being useful for conveying a web, the process comprising the steps of: providing a source of laser radiation; and, engraving the surface of the roller with radiation from the source of laser radiation to create on the surface a shallow texture with a pattern of (1) well rounded down features having a substantially uniform depth with many of the down features being interconnected and (2) generally curvatured plateaus.

In yet another aspect of the invention, an apparatus for conveying a web in a corona discharge coating process has at least one corona discharge treatment roller having a shallow textured surface with plateaus and down features as described above. Means is provided for applying a corona discharge to the web supported on the roller.

Accordingly, it is an important advantageous effect of the present invention that a roller for conveying a web in a corona discharge treatment process has a surface finish that eliminates the boundary layer air between the surface of the roller and the web. It is another advantageous effect of the present invention that the non-periodic pattern on the surface of the corona discharge treatment roller does not impart objectionable latent images on the web.

BRIEF DESCRIPTION OF THE DRAWINGS

The foregoing as well as other objects, features and advantages of this invention will become more apparent from the following detailed description when taken in conjunction with the appended figures in which.

DETAILED DESCRIPTION OF THE INVENTION

Figure 1:
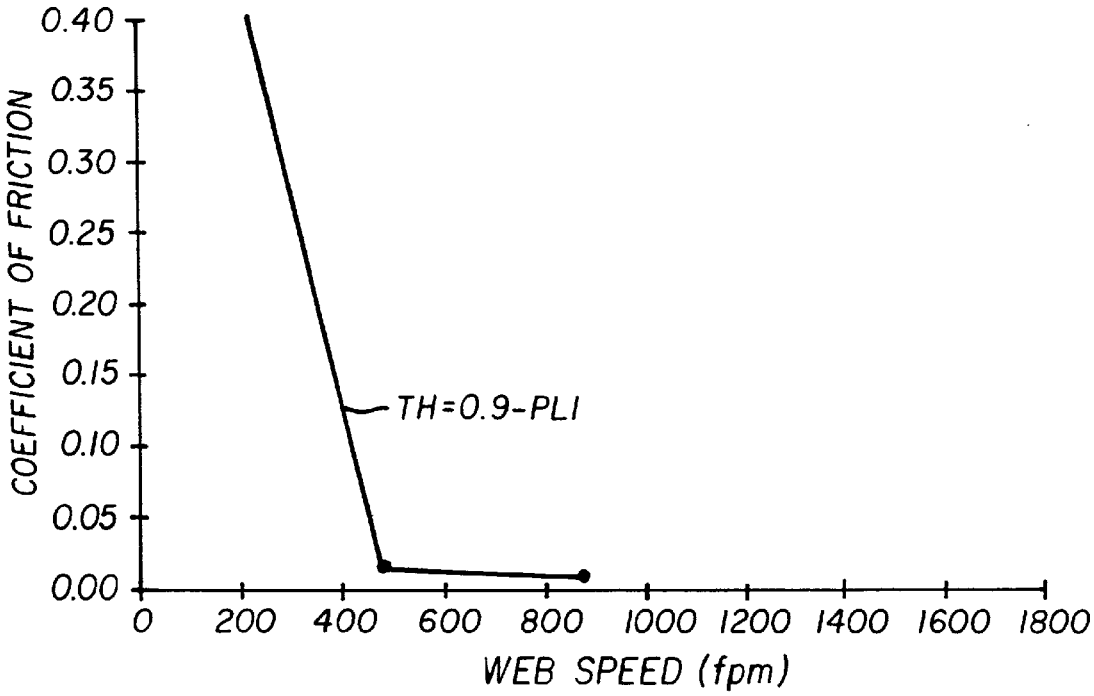
FIG. 1 (prior art)
FIG. 1 is a prior art illustration of how the measured coefficient of friction varies with web speed for a web and smooth surfaced corona discharge treatment roller.

Turning now to the drawings, and in particular to FIGS. 2–5, a dielectric type surfaced corona discharge treatment roller 10 has a surface 14 that is laser engraved with a nonperiodic type pattern (described below) for supporting a web 12. Briefly described, surface 14 of roller 10 of the invention has a plurality of interconnected channels 22 and plateaus 30 adjacent to the channels 22, as described in details below. Moreover, the process (described below) for making roller 10 can be applied to cylindrical shells or base rollers of various kinds including elastomers, ceramics, and epoxy quartz, or a combination thereof, depending upon the application and production speed requirements.

Figure 2:
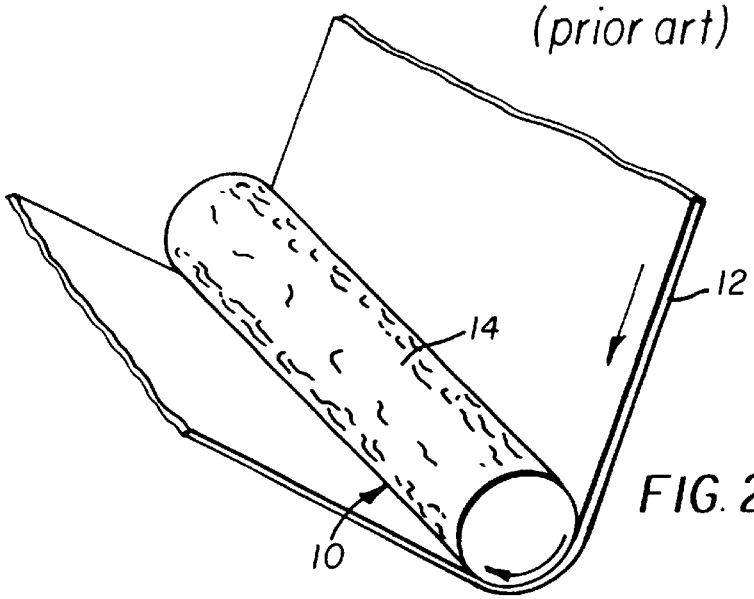
FIG. 2 is a perspective view of a corona discharge treatment roller of the invention with a web trained around a portion of the roller surface.

Referring initially to FIG. 2, web conveyance roller of the invention, generally designated 10, is rotatable about its longitudinal axis in a clockwise direction as indicated by the arrow. A web 12 is trained around a portion of the roller 10. In either instance, the velocity of the roller surface 14 and the linear velocity of the web 12 should be equal to each other so that there is no slippage between the roller and the web. This is especially important when the web 12 comprises a material which is easily damaged, such as photographic film, paper, magnetic media or the like. Surface 14 of roller 10 is especially prepared in accordance to the process of the invention to avoid relative movement between the roller 10 and the web 12.

Figure 3:
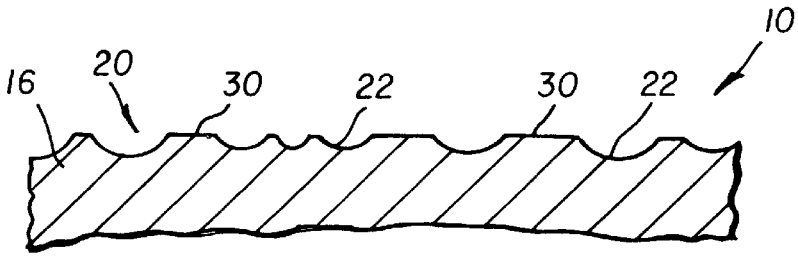
FIG. 3 is an enlarged fragmentary cross section view of the roller after it has been laser engraved with the random pattern.

Referring now to FIG. 3, the air venting pattern of the invention for roller 10 can be applied to cylindrical coverings of various kinds. The length and the diameter of the roller 10 can vary and may, for example, be of a length sufficient to accommodate webs up to about 15 feet in width.

The surface of roller 10 is laser engraved with the pattern of the invention to create the surface texture generally designated 20 in FIG. 3. Surface texture 20 has well rounded channels 22. The channels are preferably generally curved in configuration but they may have other configurations, such as a squared bottom, etc.; and, they extend the full length and circumference of the roller 10. The surface of the roller not engraved by the laser process are a series of randomly extending plateaus designated 30.

The channels 22 formed by the laser engraving operation have a depth that is determined by the laser power level being selected. This pattern depth and interconnection channeling 22 is controlled by removing a predictable amount of material from the roller surface. Pattern depth is accurately controlled and a substantially uniform depth is obtained.

Figure 4:
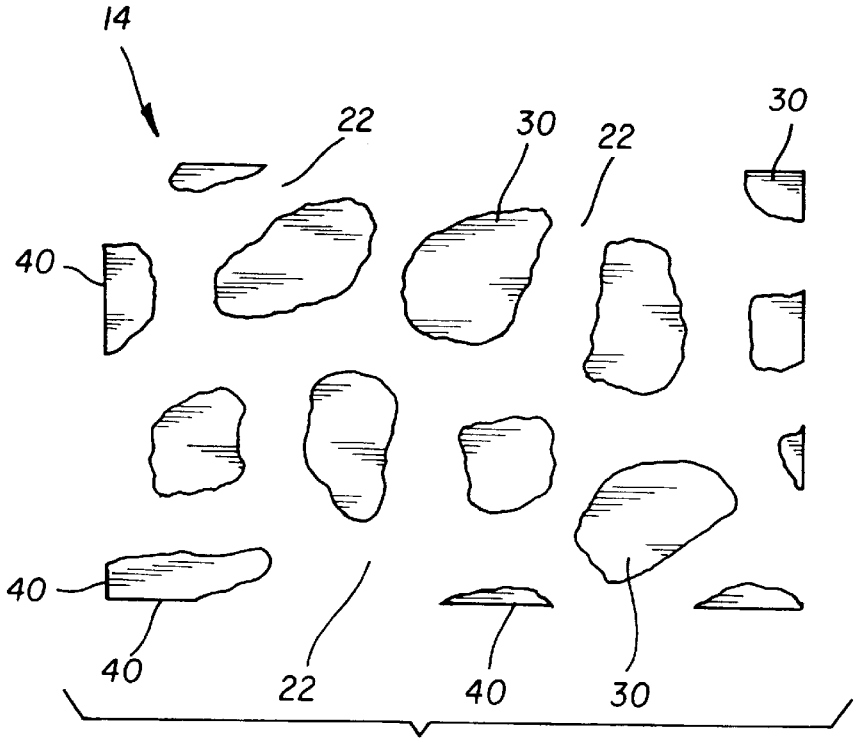
FIG. 4 is a top plan view photomicrograph of the surface of a roller of the invention with uniform channel widths pattern design.

FIG. 4 is a photomicrograph of a fragmentary portion of a surface 14 of the roller of the invention produced with the pattern (described below) of the uniform channel line width type. The surface 14 comprises a plurality of up features or plateaus 30 and a plurality of the down features or channels 22. The interconnected channels 22 are produced by connection of the channels 22 formed by the laser engraving operation. The interconnected channels 22 form pathways for air entrapped between the web 12 (FIG. 2) and the surface 14 of the roller. These pathways extend in a random manner both circumferentially and longitudinally along the roller 10. Thus air can travel both axially and circumferentially along the roller 10 to escape from between the roller 10 and the web 12. This assures good contact between the plateaus 30 and the surface of the web 12 to obtain controlled traction or friction characteristics between the roller 10 and the web 12. The traction between the roller 10 and the web 12 is predictable because very little air is entrained or trapped between the roller 10 and the web 12. If significant amounts of air became trapped between the roller 10 and the web 12 the traction characteristics of the roller 10 would be adversely affected.

Figure 5:
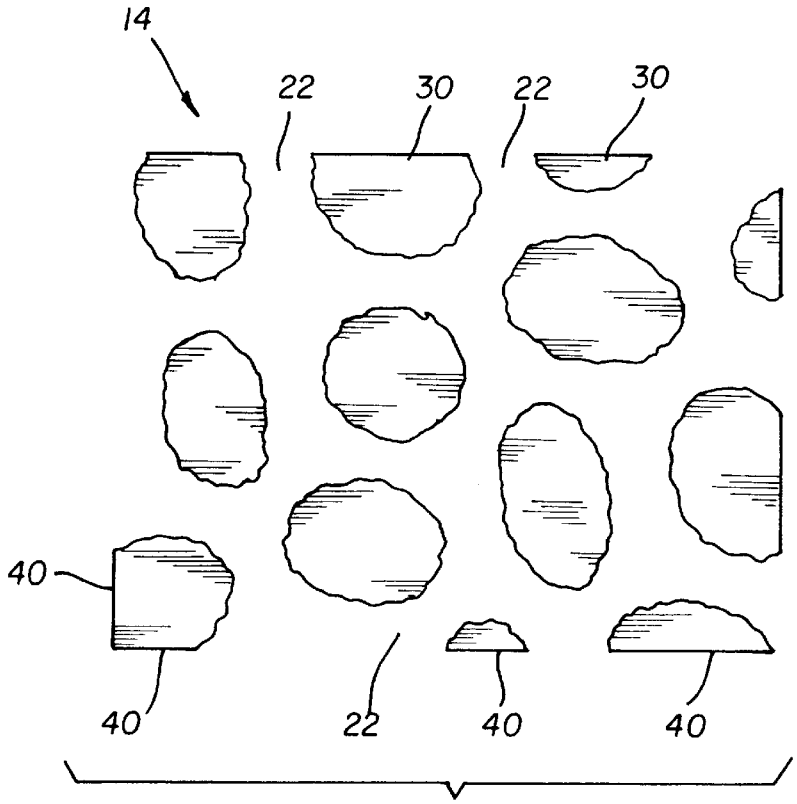
FIG. 5 is a top plan view photomicrograph of the surface of another roller of the invention with nonuniform channel widths pattern design and rounded plateau edge features.

FIG. 5 is a photomicrograph of a fragmentary portion of a surface 14 of the roller 10 of the invention produced with the pattern (described below) of the nonuniform channel line width and rounded plateau edge feature type. The surface 14 of roller 10 comprises the plateaus 30 and a plurality of the channels 22. The interconnected channels are produced by connection of the channels 22 formed by the laser engraving operation. The channels 22 are at least partially overlapping and are interconnected to form pathways for air entrapped between the web 12 (FIG. 2) and the surface 14 of the roller 10. These pathways extend in a random manner both circumferentially and longitudinally along the roller 10. Thus air can travel both axially and circumferentially along the roller 10 to escape from between the roller 10 and the web 12. This assures good contact between the plateaus 30 and the surface of the web 12 to obtain controlled traction or friction characteristics between the roller 10 and the web 12. The traction between the roller 10 and the web 12 is predictable because very little air is entrained or trapped between the roller and the web. If significant amounts of air became trapped between the roller 10 and the web 12 the traction characteristics of the roller would be adversely affected.

In order to obtain a traction characteristic greater than a ground finish of a roller, the surface 14 of the corona discharge treatment (CDT) roller 10 is laser engraved with a nonperiodic type pattern such that interconnected channels are formed comprising preferably at least 50% to about 80% of the surface area of the roller 10. Depth of the channels 22 is preferably between about 12 microns and about 125 microns. The channels 22 are uniform in width or they may be nonuniform in width permitting rounded plateau features. A plurality of plateaus 30 between channels 22 comprise preferably about 20% to about 50% of the surface area of the roller 10. Population density of plateaus 30 in surface 14 is preferably between about 1,000 and 2,000 per square inch of roller surface area Moreover, plateaus 30 may have edges with a variety of shapes including straight edges or may have curved edges.

The random nature of the pathways on the surface 14 of the roller 10 is very desirable, especially for photographic products. In our experience, any slight marks produced on the web 12 by such a random pattern can not be as readily observed by the human eye as a regular or repeating pattern of marks.

Figure 6:
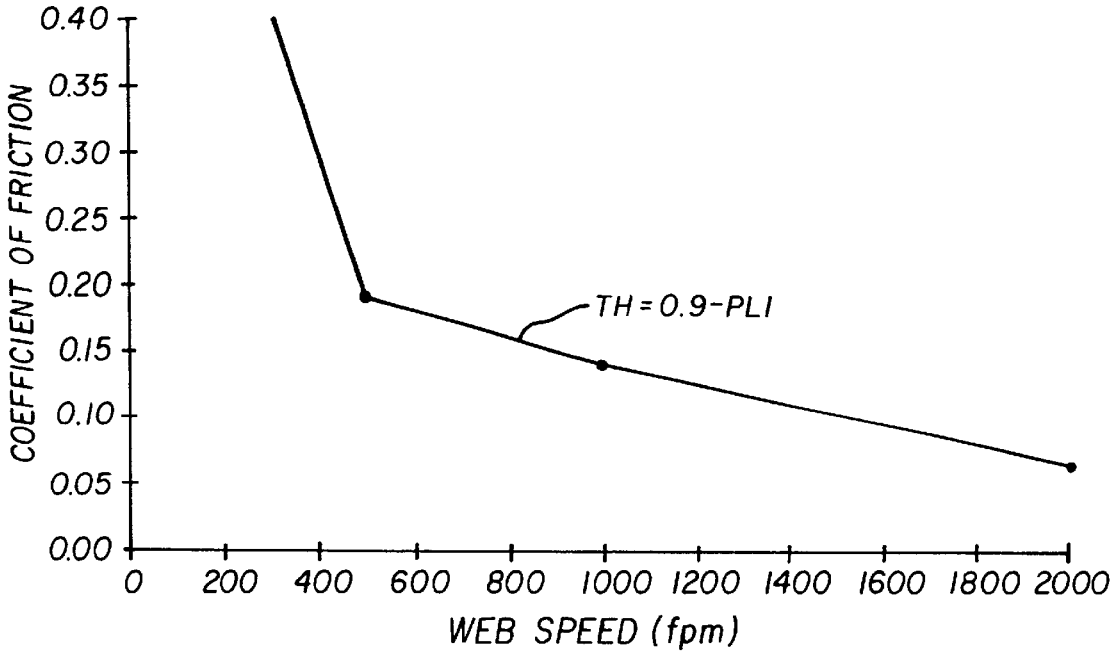
FIG. 6 illustrates how the measured coefficient of friction varies with web speed for a web running with a corona treatment roller having the surface of the type shown in FIGS. 4 and 5.

FIG. 6 illustrates how web conveyed on surface 14 of an 8 inch diameter CRT roller in accordance with the embodiment of FIGS. 4 or 5. As can be seen, the coefficient of friction between web 12 and the roller 10 drops at a low rate over a range of web 12 speed up to 2,000 feet per minute such that roller slippage is prevented.

Referring again to FIG. 2, the process for finishing surface 14 of roller 10 useful for conveying a web 12 includes the step of providing a source of laser radiation, such as a $CO_2$ laser. The laser is driven by a controller means, such as a computer, in which the pattern sequence (below) provides the input signal which drives the laser. The surface 14 of the roller 10 is then engraved with radiation from the source of laser radiation driven by the input signal to create on the surface a shallow texture with a pattern of (1) well rounded down features or channels 22 having a substantially uniform depth with many of the down features being interconnected, and (2) generally curvatured plateaus 30, as described fully above. More particularly, the pattern (see FIGS. 4 & 5) comprising plateaus 30 and down features 22 engraved on the surface 14 of roller 10 may be generated manually, i.e., by hand drawn, or by computer graphic software, such as Photoshop® by Adobe, Inc. Edges 40 of the pattern are modified to assure that adjoining patterns are not exposing a seam. This may be accomplished by manual use of the computer graphic software such that multiple individual patterns (not shown) can be tiled together in the horizontal and vertical directions to form an infinitely large seamless pattern. This process of pattern edge modification and tiling is common in the laser engraving industry.

Figure 7:
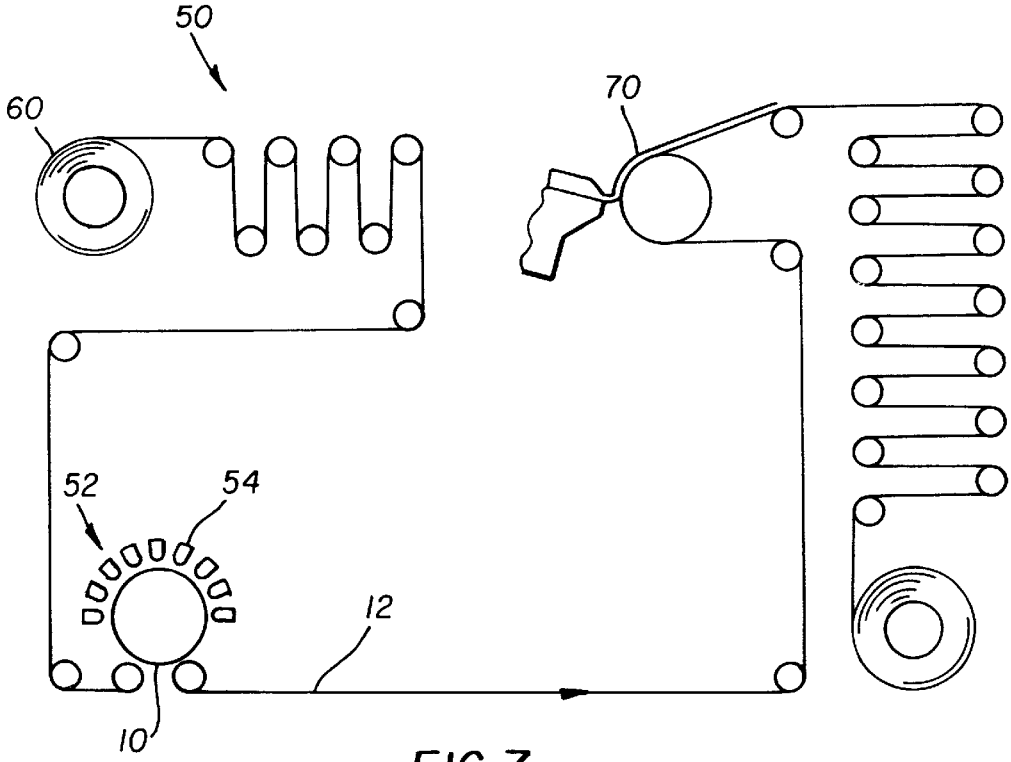
FIG. 7 is a schematic of the corona discharge treatment roller in a web coating operation.

In FIG. 7, a corona discharge treatment and coating process 50 using the roller 10 of the invention is illustrated. Web 12 from unwind station 60 is supported on roller 10 as it is conveyed through a corona discharge treatment process 52. Electrodes 54 partially surrounding and spaced apart from roller 10 provide the source of the corona discharge treatment of the web 12. This corona discharge treatment of the web 12 facilitates the coating process that occurs at stations downstream of the corona discharge treatment process. After the web is treated by the CDT roller, it then travels to the coating process 70 where a suitable coating composition, such as a photographic emulsion, is applied.

Thus, it is an unexpected result that laser engraved shallow non-periodic pattern applied to the surface of the corona discharge treatment roller would be effective at: 1) solving the problem of boundary layer air between the corona discharge treatment rollers and the surface of the web, 2) the non-periodic design of the pattern was such that it would not result in web marking after the coating process observed by the human eye.

Accordingly, the invention has been described in detail with particular reference to certain preferred embodiments thereof, but it will be understood that variations and modifications can be effected within the spirit and scope of the invention.

What is claimed is:

1. A process for finishing the surface of a roller comprising materials selected from the group consisting of elastomers, ceramics, and epoxy quartz or a combination thereof, said roller being useful for conveying a web, the process comprising the steps of:

providing a source of laser radiation; and, engraving the surface of the roller with radiation from said source of laser radiation to create on the surface a shallow texture with a pattern of (1) well rounded down features having a substantially uniform depth with many of the down features being interconnected and (2) generally curved plateaus.

2. The process recited in claim 1, further comprising, after said engraving step, the step of applying a finishing treatment to said surface to remove any protuberances from edges of said plateaus.

3. The process recited in claim 2, wherein said finishing step further includes the step of grinding said surface of said roller with grit ranging from about 15 microns to about a 3 microns grid size, the grinding step being effective to remove the protuberances but without removing the depth of the down features.

* * * * *